US007521641B2

(12) United States Patent
Huang

(10) Patent No.: US 7,521,641 B2
(45) Date of Patent: Apr. 21, 2009

(54) LAMP SOCKET WITH MULTIPLE SWITCHES

(75) Inventor: Chin-Feng Huang, Taipei (TW)

(73) Assignee: Groton Industries, Inc., Taipei (TW)

( * ) Notice: Subject to any disclaimer, the term of this patent is extended or adjusted under 35 U.S.C. 154(b) by 113 days.

(21) Appl. No.: 11/734,475

(22) Filed: Apr. 12, 2007

(65) Prior Publication Data

US 2008/0253128 A1 Oct. 16, 2008

(51) Int. Cl.
*H01H 3/08* (2006.01)

(52) U.S. Cl. ..... 200/336; 200/565

(58) Field of Classification Search ... 200/50.28–50.32, 200/51 R, 51.03–51.09, 51.12, 51.13, 51.17, 200/565, 570; 315/67, 68, 178, 313, 317; 439/236, 638–641, 168, 170, 602, 614, 883, 439/890

See application file for complete search history.

(56) References Cited

U.S. PATENT DOCUMENTS 3,049,599 A * 8/1962 Eck et al. ..... 200/51.17
4,104,565 A * 8/1978 Klassen ..... 315/178
5,214,255 A * 5/1993 Fleischhauer ..... 200/51.15
5,278,366 A * 1/1994 Fleischhauer ..... 200/51.15
5,514,006 A * 5/1996 Getselis et al. ..... 439/417
5,595,290 A * 1/1997 Hsieh ..... 200/571
5,743,757 A * 4/1998 Chen ..... 439/419
5,743,758 A * 4/1998 Cheng et al. ..... 439/419
5,783,788 A * 7/1998 Jones et al. ..... 200/51.17
6,227,912 B1 * 5/2001 Hung ..... 439/620.02
6,332,796 B1 * 12/2001 Chen ..... 439/226
6,396,009 B1 * 5/2002 Yu ..... 200/51 R
6,768,072 B1 * 7/2004 Yang ..... 200/329
7,161,101 B2 * 1/2007 Scavella ..... 200/51 R
7,198,505 B2 * 4/2007 Cherian ..... 439/419

* cited by examiner

*Primary Examiner*—Michael A Friedhofer
*Assistant Examiner*—Lisa N Klaus
(74) *Attorney, Agent, or Firm*—patenttm.us

(57) ABSTRACT

A lamp socket with multiple switches has a casing, a switching contact assembly, a stem assembly, an electric tab assembly, a photo switch, a first electric connector and a second electric connector. The switching contact assembly is mounted in the casing and around the stem assembly. The stem assembly has multiple pans. The electric tab assembly is mounted on two of the multiple pans and selectively connects the switching contact assembly. The first electric connector and the second electric connector are connected electrically to the photo switch. The electric tab assembly connects the switching contact assembly via turning the stem assembly to turn on or off a three-way bulb. Furthermore, the lamp socket turns on a three-way bulb based on ambient light.

3 Claims, 8 Drawing Sheets

LAMP SOCKET WITH MULTIPLE SWITCHES

BACKGROUND OF THE INVENTION

1. Field of the Invention

The present invention relates to a lamp socket, and especially a lamp socket with multiple switches.

2. Description of the Related Art

Conventional lamps have tungsten filaments so brightness of the lamps is the same. Therefore, a conventional three-way bulb has two tungsten filaments with different resistances so the three-way bulb has a main light and a second light to provide different brightness. When the three-way bulb is mounted in a conventional lamp socket, the main light, the second light or the main light and the second light can be turned on. However, the lamp socket does not turn on the three-way bulb based on ambient light.

SUMMARY OF THE INVENTION

The objective of the present invention is to provide a lamp socket with multiple switches to turn the socket on or off manually or by automatically sensing ambient light.

To achieve the foregoing objective, a lamp socket with multiple switches in accordance with the present invention has a casing, a switching contact assembly, a stem assembly, an electric tab assembly, a photo switch, a first electric connector and a second electric connector. The switching contact assembly is mounted in the casing and around the stem assembly. The stem assembly is mounted in and extends from the casing and has multiple pans. The electric tab assembly is mounted on two of the multiple pans and is selectively connected to the switching contact assembly. The first electric connector and the second electric connector are connected electrically to the photo switch. The electric tab assembly is connected electrically to the switching contact assembly via turning the stem assembly to turn on or off a three-way bulb. Furthermore, the lamp socket turns on a three-way bulb based on ambient light. Therefore, the lamp socket has multiple switches and can turn on or off the light automatically by the photo switch or manually.

Other objectives, advantages and novel features of the invention will become more apparent from the following detailed description when taken in conjunction with the accompanying drawings.

BRIEF DESCRIPTION OF THE DRAWINGS

FIG. 7 is an operational rear view of the stem assembly, switching contact assembly and a circuit board in the bulb socket in FIG. 1 when a second light is turned on; and FIG. 8 is an operational rear view of the stem assembly, switching contact assembly and a circuit board in the bulb socket in FIG. 1 when the second light and a main light are turned on.

DETAILED DESCRIPTION OF THE PREFERRED EMBODIMENTS

Figure 1:
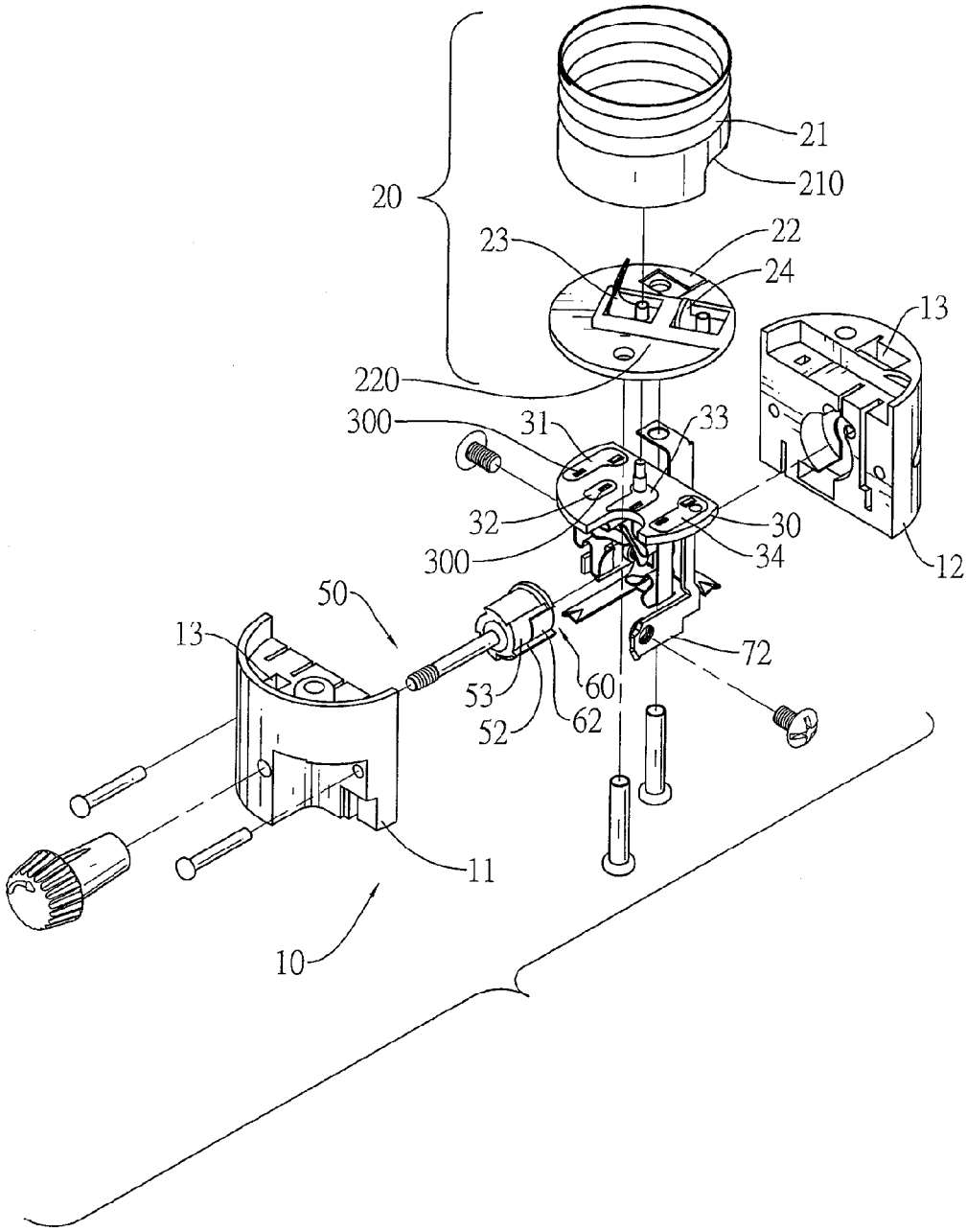
FIG. 1 is an exploded perspective view of a lamp socket with multiple switches in accordance with the present.
Figure 2:
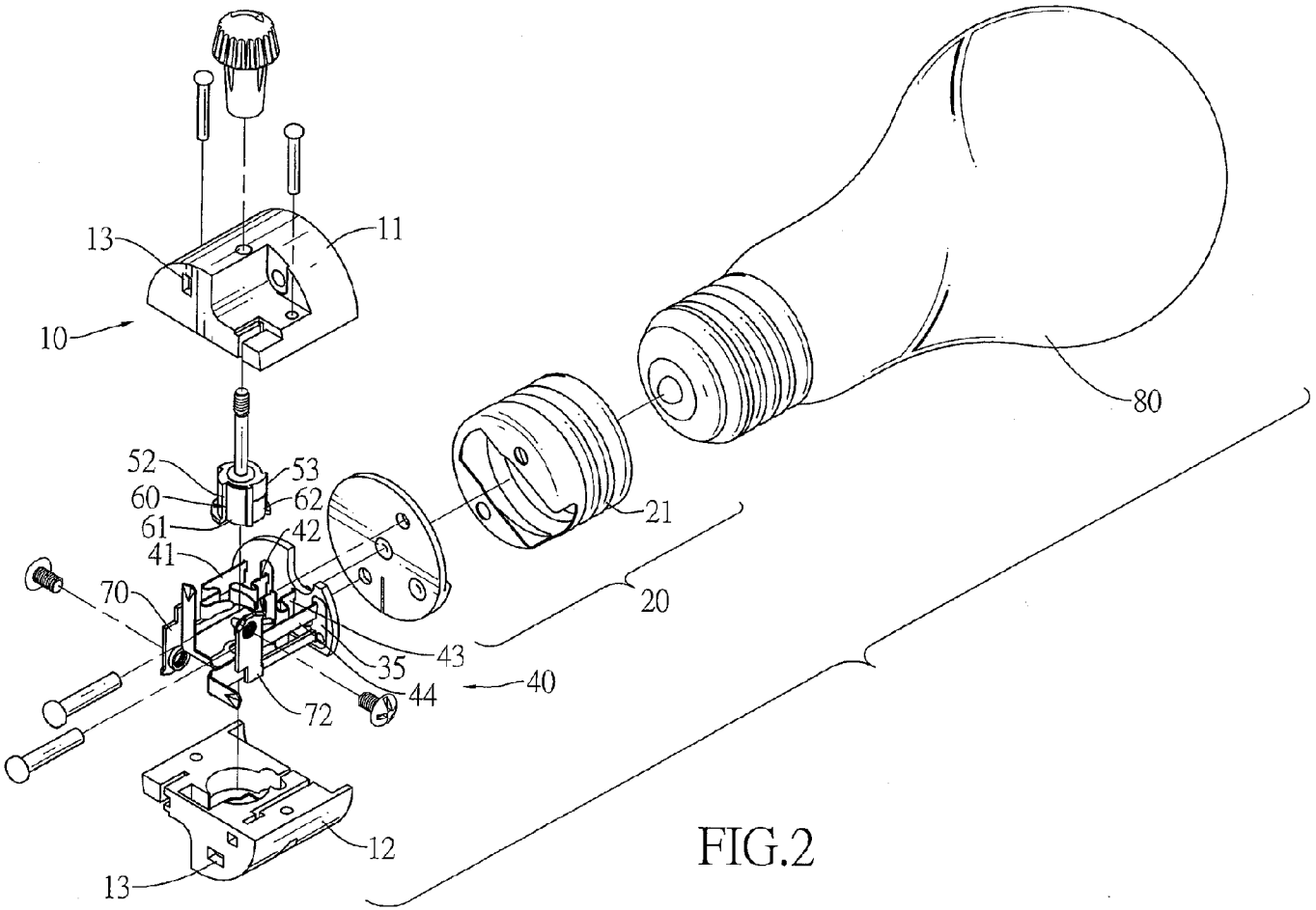
FIG. 2 is an exploded perspective view of the lamp socket in FIG. 1 with a three-way bulb.
Figure 4:
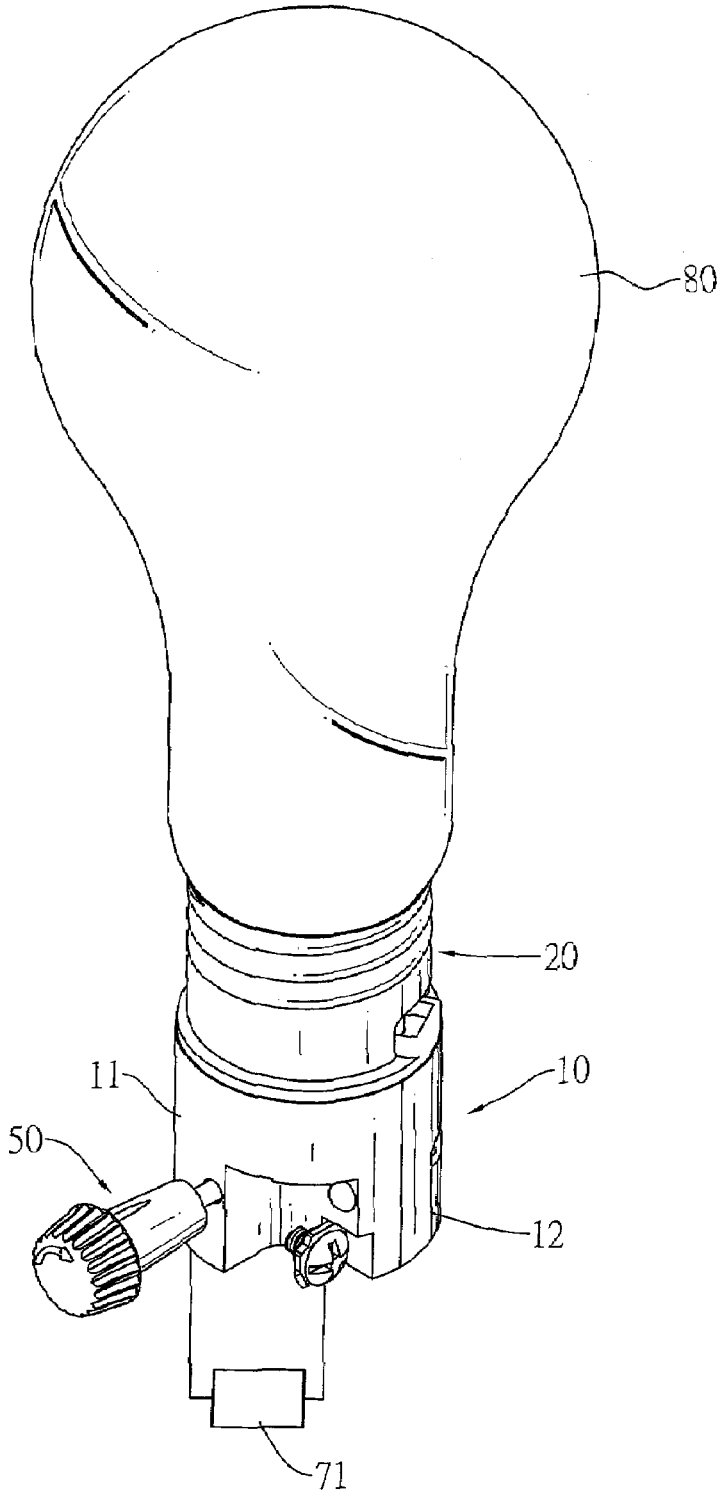
FIG. 4 is a perspective view of the lamp socket in FIG. 2 with the three-way bulb.

With reference to FIGS. 1, 2 and 4, a lamp socket with multiple switches in accordance with the present invention comprises a three-way bulb socket (20), a casing (10), a circuit board (30), a switching contact assembly (40), a stem assembly (50), an electric tab assembly (60), a photo switch (71), a first electric connector (70) and a second electric connector (72)

The three-way bulb socket (20) holds a three-way bulb (80) and has a bulb socket (21), an insulated base (22), a primary filament contact (23) and a secondary filament contact (24). The bulb socket (21) is hollow, cylindrical and conductive and has a sidewall, a bottom and a slot (210). The sidewall is threaded and holds a three-way bulb (80). The slot (210) is formed through the bottom and the sidewall near the bottom. The insulated base (22) is mounted on the bottom of the bulb socket (21) and has a top surface, a center, an outer edge and a bulb socket recess (220). The bulb socket recess (220) is formed in the top surface of the insulated base (22) between the center and the outer edge and aligns with the bottom of the bulb socket (21) outside the slot (210). The primary filament contact (23) is mounted securely through the center of insulated base (22), protrudes through the slot (210) in the bulb socket (21) and makes electrical contact with the three-way bulb (80) screwed into the bulb socket (21). The secondary filament contact (24) is mounted securely through the insulated base (22) between the center and the outer edge, protrudes through the slot (210) in the bulb socket (21) and makes electrical contact with the three-way bulb (80) screwed into the bulb socket (21).

The casing (10) is cylindrical and has a top, a bottom, a front casing half (11) and a rear casing half (12). The front casing half (11) is hollow and semicylindrical and has a through hole (13) and a top. The through hole (13) is defined through the front casing half (11) so a first external wire passes through the through hole (13) to provide power. The rear casing half (12) attaches to the front casing half (11), is hollow and semicylindrical and has a through hole (13) and a top. The through hole (13) is defined through the second casing half (12) so a second external wire passes through the through hole (13) and is connected electrically to the sidewall of the bulb socket (21) to provide power.

Figure 3:
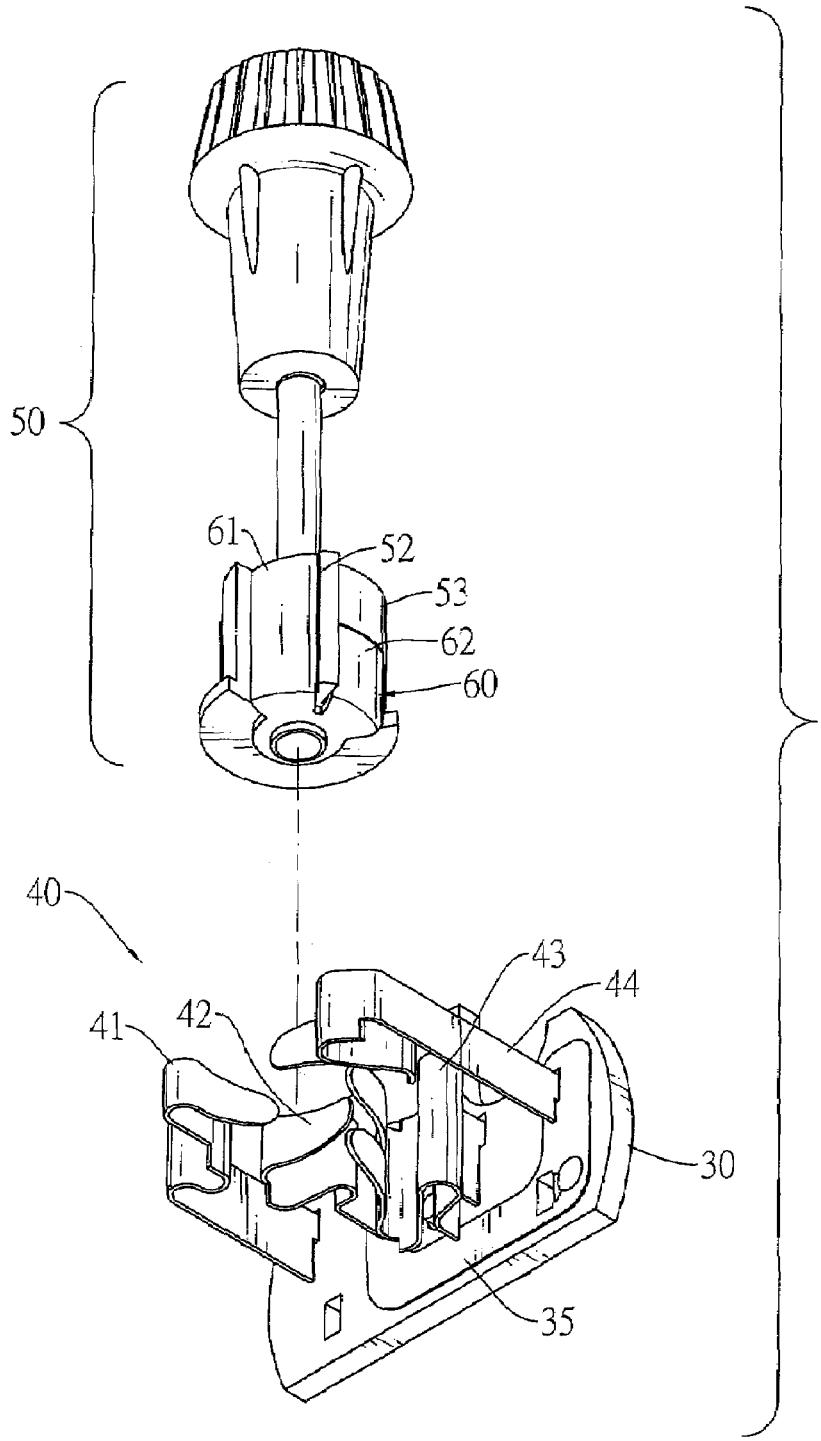
FIG. 3 is an exploded perspective view of a stem assembly, a switching contact assembly and a circuit board in the bulb socket in FIG. 1.

With further reference to FIGS. 1 and 3, the circuit board (30) is mounted on the top of the casing (10) against the insulated base (22) of the three-way bulb socket (20), is connected electrically to the primary filament contact (23) and the secondary filament contact (24) and has a top surface, a bottom surface, an outer edge, multiple holes (300), a first contact (31), a second contact (32), a third contact (33), a fourth contact (34) and a crossover contact (35). The holes are formed through the circuit board (30). The first contact (31) is formed on the top surface of the circuit board (30) near the outer edge and communicates with one of the holes. The second contact (32) is formed on the top surface of the circuit board (30) adjacent to the first contact (31) between the center and the outer edge and communicates with another multiple holes (300). The third contact (33) is formed on the top surface of the circuit board (30) at the center, communicates with another multiple holes (300) and is connected electrically to the first filament contact (23). The fourth contact (34)

is formed on the top surface of the circuit board (30) near the outer edge diametrically opposite to the first contact (31), communicates with another multiple holes (300) and is connected electrically to the second filament contact (24). The crossover contact (35) is U-shaped, is formed on the bottom surface of the circuit board (30) and communicates with the multiple holes (300) communicating with the second and fourth contacts (32, 34).

With further reference to FIG. 3, the switching contact assembly (40) is mounted in the front casing half (11) and the rear casing half (12), passes through the circuit board (30) and has a first flexible tab (41), a second flexible tab (42), a third flexible tab (43) and a fourth flexible tab (44). The fourth flexible tab (44) has a width and a free end. The width of the third flexible tab (43) is wider than the first flexible tab (41), the second flexible tab (42) and the fourth flexible tab (44).

The stem assembly (50) is mounted through the front casing half (11) and has a proximal end, a cylinder, multiple protrusions (52) and multiple pans (53). The cylinder is mounted securely on the proximal end. The multiple protrusions (52) are formed on and protrude radially from the cylinder of the stem assembly (50). The multiple pans (53) are defined in the cylinder of the stem assembly (50) and selectively contact the free ends of the first, second, third and fourth flexible tabs (41, 42, 43, 44) of the switching contact assembly (40) respectively. Each pan (53) is located between adjacent two protrusions (52) and has a surface.

The electric tab assembly (60) is mounted on the cylinder of the stem assembly (50), is mounted in adjacent two pans (53), selectively contacts the switching contact assembly (40) and is connected electrically to the first external wire. The electric tab assembly (60) further has a whole electric tab (61) and a partial electric tab (62). The whole electric tab (61) is mounted on a whole of the surface of one of the multiple pans (53) and selectively contacts the switching contact assembly (40). The partial electrical tab (62) is mounted on a half of the surface of one pan (53) adjacent to the whole electric tab (61) and is connected electrically to the third flexible tab (43).

With further reference to FIG. 4, the photo switch (71) may have a photo resistor. The photo switch (71) determines whether the light is weak or not according to voltage potential changes of the photo resistor.

The first electric connector (70) connects the first contact (31) with the photo switch (71).

The second electric connector (72) connects the fourth contact (34) with the photo switch (71).

Figure 5:
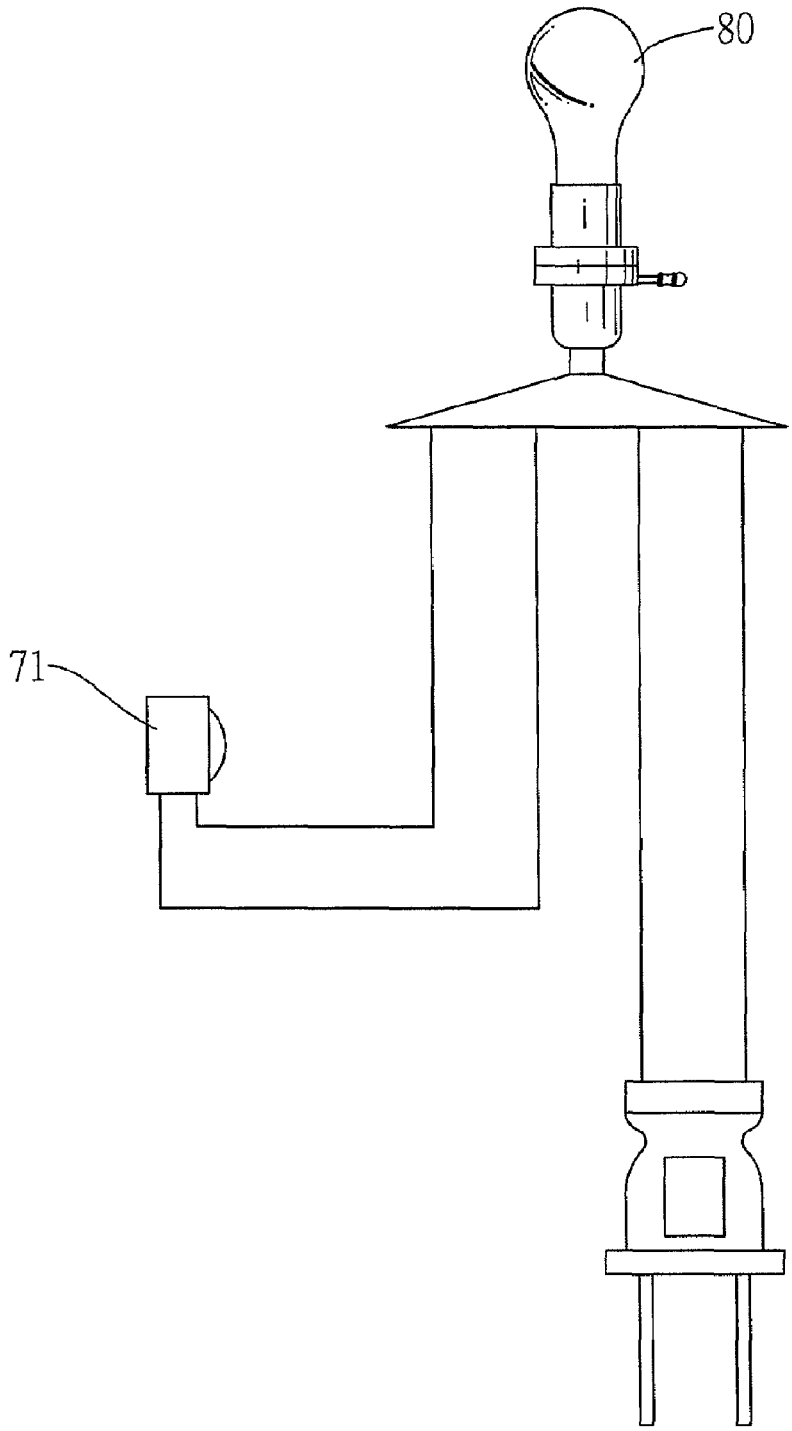
FIG. 5 is a circuit diagram of the lamp socket and three-way bulb in FIG. 4.

With reference to the FIG. 5, the first external wire and the secondary external wire pass respectively through the through holes (13). The first electric connector (70) and the second connector (72) connect to the photo switch (71).

Figure 6:
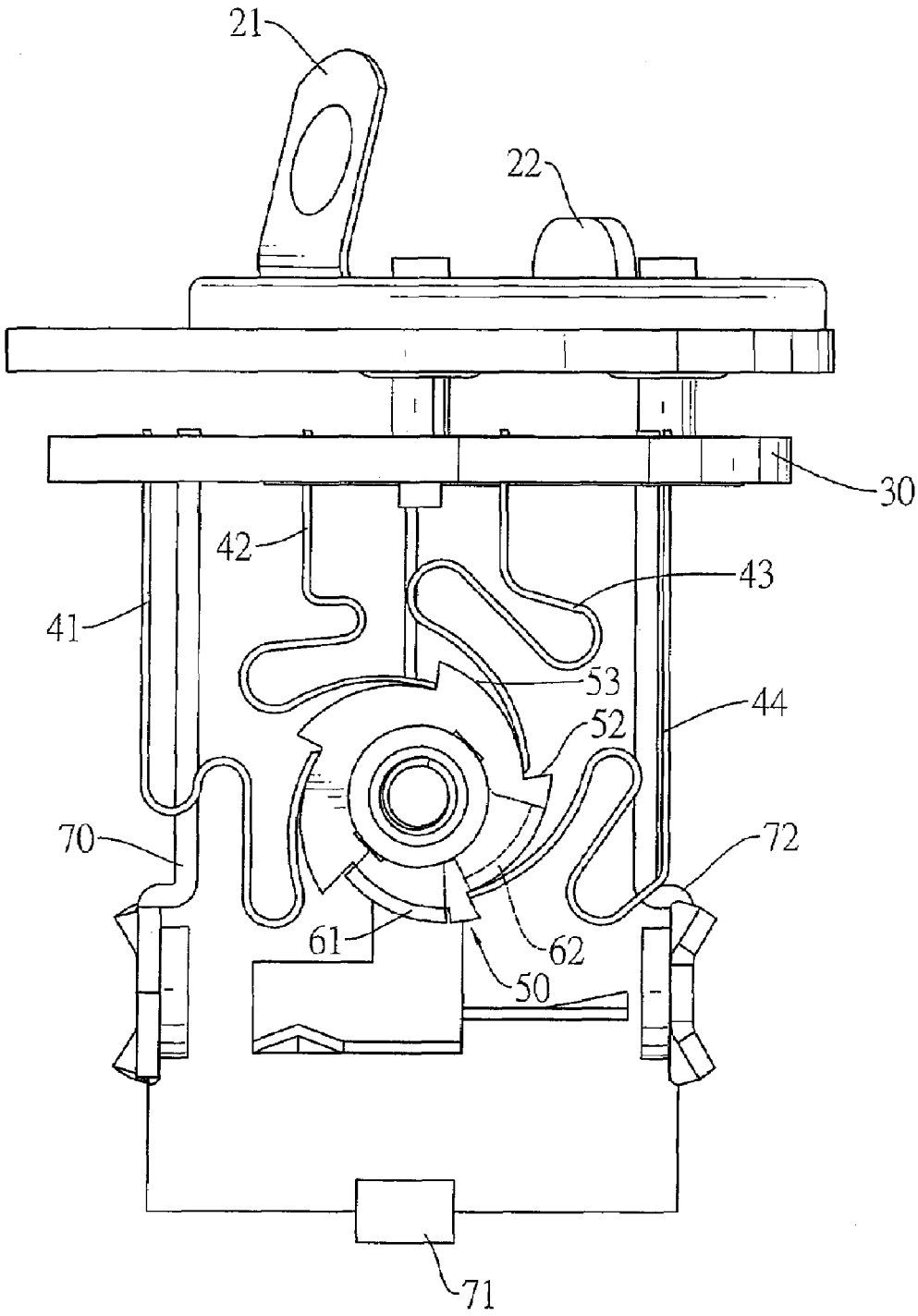
FIG. 6 is an operational rear view of the stem assembly, switching contact assembly and a circuit board in the bulb socket in FIG. 1 when the bulb socket is turned off.

The three-way bulb (80) is mounted on the three-way bulb socket (20). Each circuits is formed via the primary filament contact (23) and the sidewall of the three-way bulb socket (20) or the secondary filament contact (24) and the sidewall of the three-way bulb socket (20). Circuits can be activated or be deactivated by hand or one of the circuits can be activated or be deactivated by the photo switch (71). To explain how to use the bulb socket, the lamp socket has five switches and the three-way bulb (80) has a main light and a secondary light so variable brightness is presented. With reference to FIG. 6, when turning off the lamp socket, the first flexible tab (41), the second flexible tab (42) and the third flexible tab (43) directly contact three of the multiple pans (53). Although the fourth flexible (44) contacts the pan (53) with the partial electric tab (62), the fourth flexible tab does not attach the partial electric tab (62). Therefore, the main light and the secondary light do not be turned on.

Figure 7:
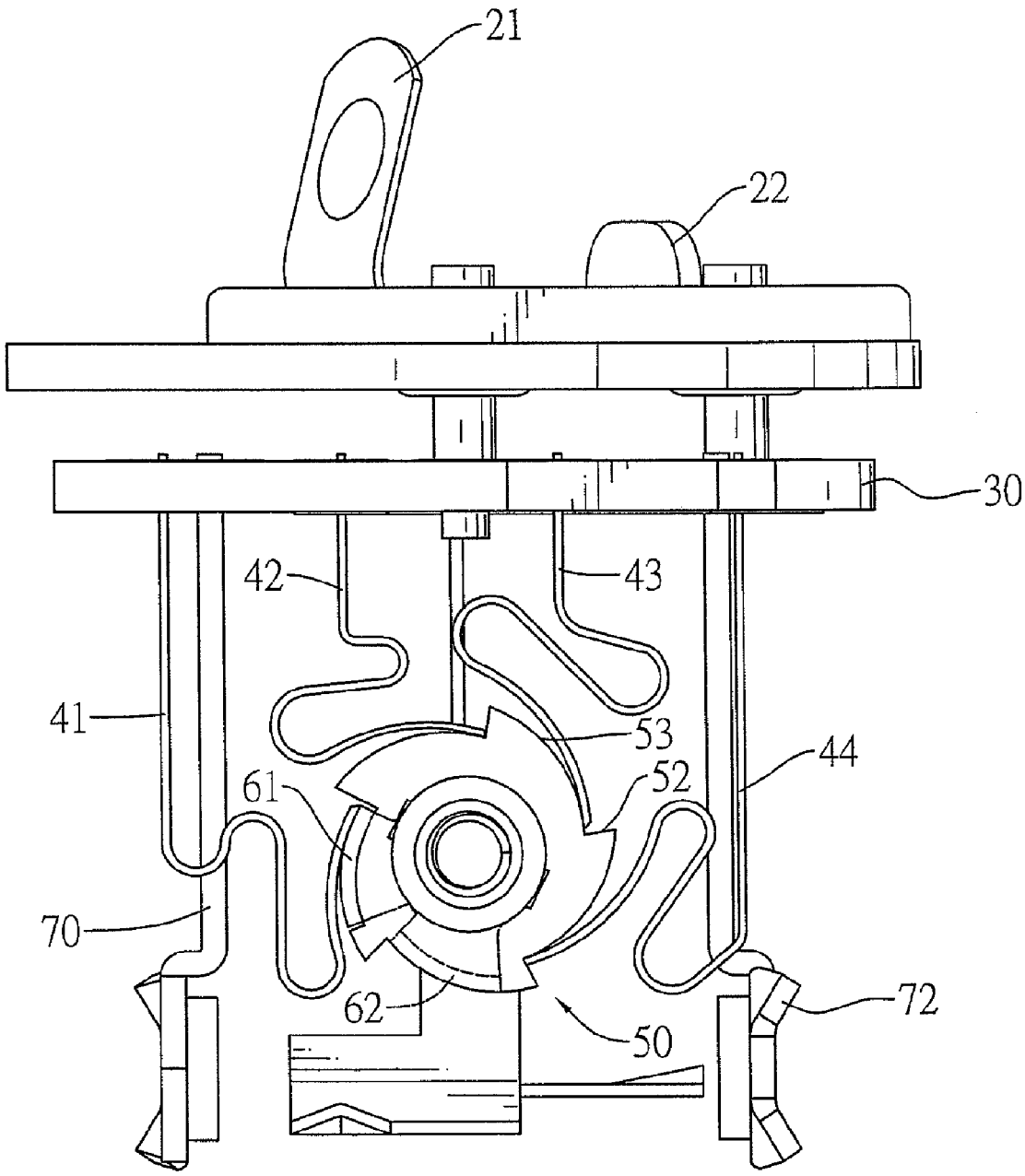

With reference to FIG. 7, the whole electric tab (61) attaches the first flexible tab (41) after a user turns the stem assembly (50). The current flows through the electric tab assembly (60), the first flexible tab (41), the first contact (31), the first electric connector (70) and the photo switch (71). When the photo switch (71) determines that ambient light is weak, the current flows through the second electric connector (72), the fourth contact (34) and the secondary filament contact (22) to turn on the second light.

After the user clockwise turns the stem assembly (50) again, the whole electric tab (61) contacts the second flexible tab (42). The current flows through the electric tab assembly (60), the second flexible tab (42), the crossover contact (35), the fourth contact (34) and the secondary filament contact (24) to turn on the second light.

After the user clockwise turns the stem assembly (50) again, the whole electric tab (61) contacts the third flexible tab (43). The current flows the electric tab assembly (60), the third flexible tab (43), the third contact (33) and the primary filament contact (23) to turn on the main light.

Figure 8:
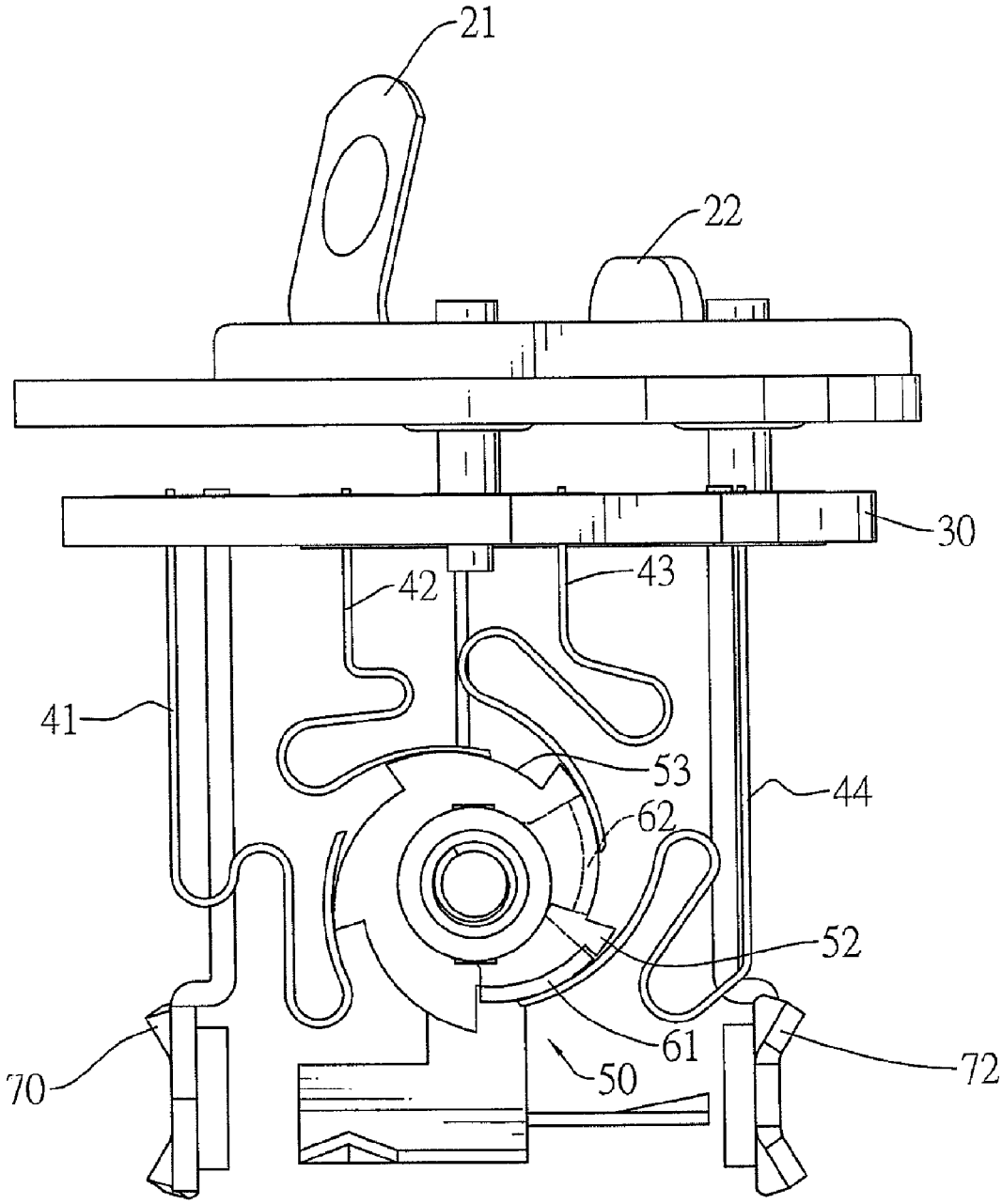

With reference to FIG. 8, after the user clockwise turns the stem assembly (50) again, the whole electric tab (61) contacts the fourth flexible tab (44) and the partial electric tab (62) contacts the third flexible tab (43). Therefore, current not only flows through the electric tab assembly (60), the third flexible tab (43), the third contact (33) and the primary filament contact (23) to turn on the main light but also flows through the fourth flexible tab (44) and the secondary filament contact (24) to turn on the second light. The lamp socket has multiple switches and can turn on or off the second light via the photo switch. Therefore, the lamp socket with multiple switches turns the socket on or off manually or by automatically sensing ambient light.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A lamp socket with multiple switches comprising a three-way bulb socket adapted to hold a three-way bulb and having a bulb socket being hollow, cylindrical and conductive and having a sidewall threaded and adapted to hold the three-way bulb;

a bottom; and a slot formed through the bottom and the sidewall near the bottom;

an insulated base mounted on the bottom of the bulb socket and having a top surface;

a center;

an outer edge; and a bulb socket recess formed in the top surface of the insulated base between the center and the outer edge and aligning with the bottom of the bulb socket outside the slot;

a primary filament contact mounted securely through the center of insulated base, protruding through the slot in the bulb socket and adapted to make electrical contact with the three-way bulb screwed into the bulb socket; and a secondary filament contact mounted securely through the insulated base between the center and the outer edge, protruding through the slot in the bulb socket and adapted to make electrical contact with a three-way bulb screwed into the bulb socket;

a casing being cylindrical and having a top;

a bottom;

a front casing half being hollow and semicylindrical and having a through hole defined through the front casing half adapted to provide a first external wire passing through the through hole to provide power; and a rear casing half attaching the front casing half, being a hollow and semicylindrical and having a through hole defined through the rear casing half;

a circuit board mounted on the top of the casing against the insulated base of the three-way bulb socket, being connected electrically to the primary filament contact and the secondary filament contact and having a top surface;

a bottom surface;

an outer edge;

multiple holes formed through the circuit board;

a first contact formed on the top surface of the circuit board near the outer edge and communicating with one of multiple holes;

a second contact formed on the top surface of the circuit board adjacent to the first contact between the center and the outer edge and communicating with another multiple holes;

a third contact formed on the top surface of the circuit board at the center, communicating with another multiple holes and connected electrically to the first filament contact; and a fourth contact formed on the top surface of the circuit board near the outer edge diametrically opposite to the first contact, communicating with another multiple holes and connected electrically to the second filament contact; and a crossover contact being U-shaped, formed on the bottom surface of the circuit board and communicating with the multiples holes communicating with the second and fourth contacts;

a switching contact assembly mounted in the first casing and the second casing, passing through the circuit board and having a first flexible tab having a width; and a free end;

a second flexible tab having a width; and a free end;

a third flexible tab having a width being wider; and a free end; and a fourth flexible tab having a width; and a free end;

a stem assembly mounted through the first casing and having a proximal end;

a cylinder mounted securely on the proximal end;

multiple protrusions formed on and protruding radially from the cylinder of the stem assembly; and multiple pans defined in the cylinder of the stem assembly and selectively contacting the free ends of the first, second, third and fourth flexible tabs of the switching contact assembly and each pan located between adjacent two protrusions and having a surface;

an electric tab assembly mounted on the cylinder of the stem assembly, mounted in adjacent two pans and selectively contacting the switching contact assembly;

a photo switch;

a first electric connector connecting the first contact with the photo switch; and a second electric connector connecting the fourth contact with the photo switch.

2. The lamp socket as claimed in claim 1, the third flexible tab is wider than the first flexible tab, the second flexible tab and the fourth flexible tab.

3. The lamp socket as claimed in claim 2, wherein the electric tab assembly has a whole electric tab mounted on a whole of the surface of one of the multiple pans and selectively contacting the switching contact assembly; and a partial electric tab mounted on a half of the surface of one pan adjacent to the whole electric tab and connecting electrically to the third flexible tab.

* * * * *